US006764031B2

(12) United States Patent
Sebastian et al.

(10) Patent No.: US 6,764,031 B2
(45) Date of Patent: Jul. 20, 2004

(54) FUEL INJECTION VALVE

(75) Inventors: Thomas Sebastian, Stuttgart (DE); Jens Pohlmann, Schwieberdingen (DE); Martin Maier, Moeglingen (DE); Guenter Dantes, Eberdingen (DE); Detlef Nowak, Untergruppenbach (DE); Joerg Heyse, Besigheim (DE); Joerg Schlerfer, Bietigheim-Bissingen (DE)

(73) Assignee: Robert Bosch GmbH, Stuttgart (DE)

( * ) Notice: Subject to any disclaimer, the term of this patent is extended or adjusted under 35 U.S.C. 154(b) by 31 days.

(21) Appl. No.: 10/182,517

(22) PCT Filed: Nov. 29, 2001

(86) PCT No.: PCT/DE01/04462

§ 371 (c)(1),
(2), (4) Date: Nov. 6, 2002

(87) PCT Pub. No.: WO02/44552

PCT Pub. Date: Jun. 6, 2002

(65) Prior Publication Data

US 2003/0132320 A1 Jul. 17, 2003

(30) Foreign Application Priority Data

Nov. 30, 2000 (DE) ..... 100 59 420

(51) Int. Cl.[7] ..... B05B 1/30

(52) U.S. Cl. ..... 239/584; 239/494; 239/497; 239/552; 239/533.12; 239/585.4; 239/596

(58) Field of Search ..... 239/491, 494, 239/497, 552, 533.3, 533.8, 533.9, 533.11, 533.12, 584, 585.1, 585.4, 585.5, 596

(56) References Cited

U.S. PATENT DOCUMENTS

| | | | | | |
|---|---|---|---|---|---|
| 5,273,215 | A | * | 12/1993 | Hans et al. | 239/533.12 |
| 5,285,970 | A | * | 2/1994 | Maier et al. | 239/596 |
| 5,540,387 | A | * | 7/1996 | Reiter et al. | 239/596 |
| 5,570,841 | A | * | 11/1996 | Pace et al. | 239/585.1 |
| 5,762,272 | A | * | 6/1998 | Tani et al. | 239/552 |
| 5,924,634 | A | * | 7/1999 | Arndt et al. | 239/596 |
| 6,070,812 | A | * | 6/2000 | Tani et al. | 239/552 |
| 6,089,476 | A | * | 7/2000 | Sugimoto et al. | 239/596 |
| 6,330,981 | B1 | * | 12/2001 | Nally et al. | 239/585.4 |

FOREIGN PATENT DOCUMENTS

| | | |
|---|---|---|
| DE | 196 36 396 | 3/1998 |
| DE | 198 27 219 | 1/1999 |
| DE | 198 04 463 | 8/1999 |
| DE | 198 56 920 | 6/2000 |
| WO | WO 94 00686 | 1/1994 |

* cited by examiner

*Primary Examiner*—Steven J. Ganey
(74) *Attorney, Agent, or Firm*—Kenyon & Kenyon

(57) ABSTRACT

A fuel injector for fuel injection systems of internal combustion engines has a valve needle (3) and, mechanically linked thereto, a valve closing body (4), which cooperates with a valve seat surface (6) disposed in a valve seat body (5) to form a sealing seat, and has a plurality of recesses (34), which are introduced in the valve seat body (5) downstream from the sealing seat. Situated downstream on the valve seat body (5) is a flow-through screen (31) in which, for each recess (34), at least one discharge orifice (7) is introduced, whose cross-section is smaller than that of the particular recess (34) and which is positioned such that its inlet cross-section is situated fully within the outlet cross-section of the particular recess (34).

7 Claims, 2 Drawing Sheets

FUEL INJECTION VALVE

BACKGROUND INFORMATION

Figure 1:
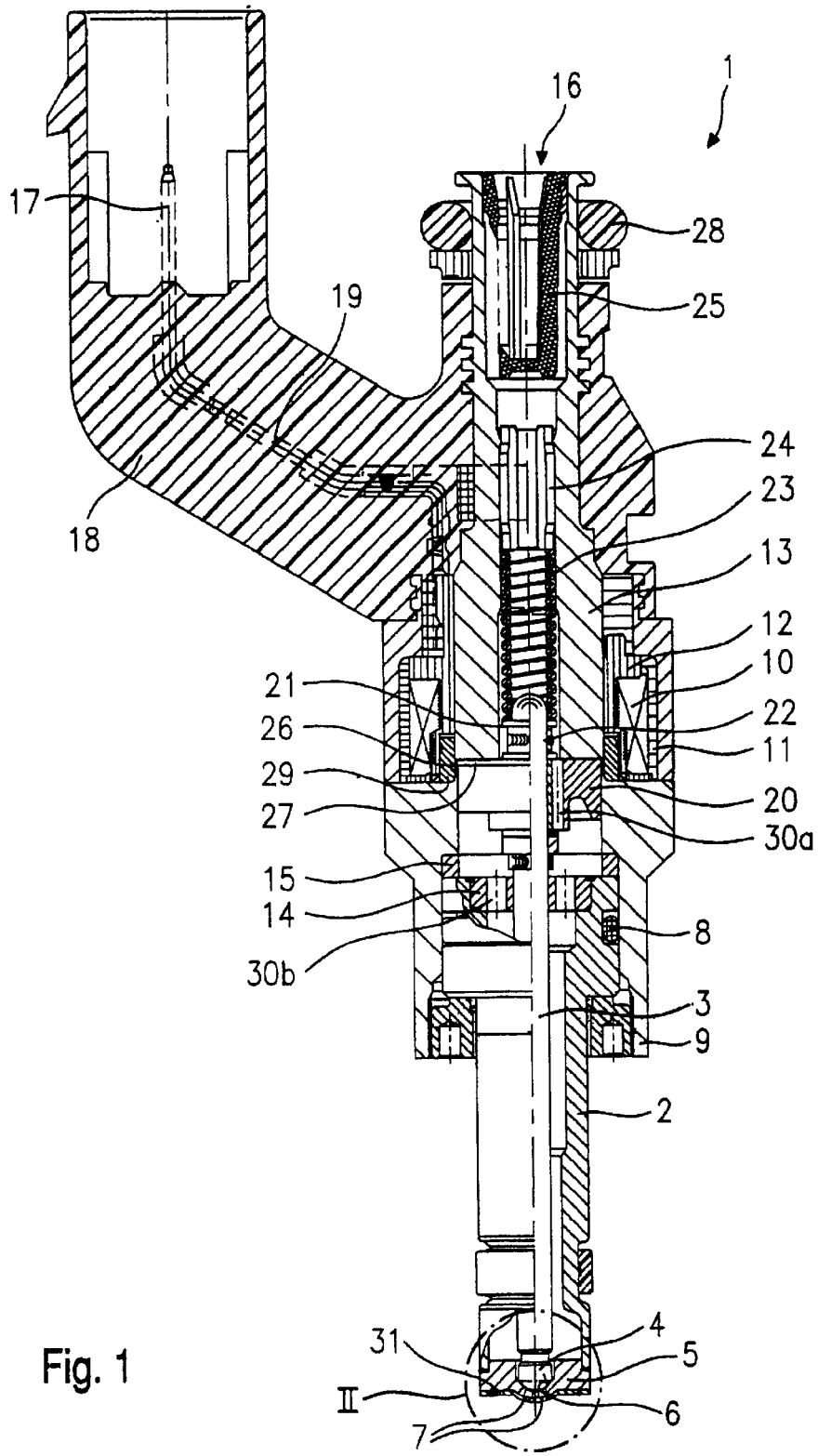

The present invention is directed to a fuel injector according to the definition of the species in the main claim.

Fuel injectors having a plurality of discharge orifices are known. They feature a plurality of discharge orifices, mostly designed as bore holes, downstream from a sealing seal formed by a valve needle and a valve seat surface. Fuel is discharged through these discharge orifices when the valve needle is lifted.

German Patent Application 198 27 219 A, for example, describes fuel injectors which have a spray orifice disk at the downstream end. Discharge orifices divided into several hole circles are arranged in this spray orifice disk. In order to form a certain discharge geometry, the discharge orifices are introduced in the spray orifice disk at different angles relative to the central axis of the fuel injector. Thus, for a flat spray orifice disk, the individual jets which are discharged from discharge orifices of the internal and external hole circles interfere with one another as they spread. In order to achieve sufficient jet deflection, the thickness of the spray orifice disk is so large that the flow length along the discharge orifice is large compared to the diameter of the discharge orifice.

Furthermore, a fuel injector is known from German Patent Application 198 04 463 A1 in which a plurality of discharge orifices are introduced in the valve seat body. The fuel injector is shaped conically outwardly in the area of the discharge orifices. The discharge orifices are introduced directly in the valve seat body and positioned on several hole circles, for example, downstream from the sealing seat.

Disadvantageous in the above-described fuel injectors are the thick-walled components in which the discharge orifices are to be introduced. These are required to withstand the high fuel pressure and combustion chamber pressure.

The radial dimensions of the discharge orifices cannot be selected to be as small as desired due to the thick-walled design, since limits are set by the possible aspect ratio as a result of the machining operations that can be used. The situation can be remedied by reducing the number of discharge orifices. This increases the radial dimensions of the individual discharge orifices while simultaneously preserving the total discharge cross-section. The result, however, is undesirable concentration gradients of the fuel mixture in the combustion chamber.

Conventional machining operations, such as drilling, for example, can, in fact, be employed to great workpiece depths; however, they increase the dimensional tolerances. The result is a greater tolerance for the flow rate. This makes optimizing the flow rate difficult, which ultimately results in higher consumption of the internal combustion engine and deterioration of the exhaust characteristics.

If the geometry of the fuel injector is not flat in the area of the discharge orifices, it is even more difficult to introduce the discharge orifices.

ADVANTAGES OF THE INVENTION

The fuel injector according to the present invention having the features of the main claim has the advantage over the related art that the flow-through screen is manufacturable from a thin membrane or a thin sheet of metal, for example. This allows very small discharge orifices to be introduced using cost-effective methods. For example, if the discharge orifices are punched into the flow-through screen, radial elongations in the area of the flow-through screen's thickness may be easily implemented.

Another advantage attained by positioning the thin flow-through screen downstream from the valve seat body is that the flow-through screen does not have any mechanically supporting functions. The housing is terminated at the downstream end of the fuel injector by the valve seat body. Therefore, a plurality of small discharge orifices may be introduced in the flow-through screen, resulting in a distinct improvement in the conditioning of the discharged fuel, and the fuel forms a largely homogeneous mixture cloud.

The tolerances of the discharge orifices to be introduced may be kept tight using highly reproducible methods such as punching, for example. The resulting piece-to-piece scattering is small and facilitates the design of the fuel injector. Finally, in this manner, the fuel consumption of the engine may be reduced.

Advantageous refinements of the fuel injector according to the present invention having the characterizing features of the main claim are rendered possible by the measures delineated in the characterizing features of the subclaims.

Thus, for example, only a small number of recesses may be introduced in the valve seat body, which greatly facilitates machining. However, fuel is metered in through a plurality of small discharge orifices in the flow-through screen. This preserves the proper conditioning of the fuel spray, although only a small number of recesses must be introduced in the thick-walled valve seat body, which, in addition, may have coarse tolerances.

The valve seat body and the flow-through screen may have a dome-shaped geometry. This contributes to a low coking tendency, in addition to the possibility of introducing the discharge orifices in the thin flow-through screen perpendicularly, the flow-through screen only being given its final shape subsequently. This guarantees a perpendicular discharge of the fuel from the discharge orifices and prevents the flow-through screen from being wetted, which further reduces the danger of coking.

Furthermore, the design of the flow-through screen as a membrane is advantageous. Atomization may be supported by vibrations, which are easily induced in a thin membrane. Improved atomization also reduces the time required to vaporize the fuel. In particular, in direct injection engines, this enables injection with optimized consumption, since a retarded injection timing may be selected.

Due to the configuration of the inside of the valve seat body which matches that of the valve closing body, there is almost no dead volume. This prevents the undischarged fuel from being evaporated on the hot fuel injector after the end of the discharge operation, which would result in emission peaks. In addition, at the beginning of the following discharge operation the response time is reduced, since no volume has to be filled with fuel before the fuel pressure required for forming a fine fuel spray is applied to the discharge orifices.

DRAWING

An exemplary embodiment of the fuel injector according to the present invention is schematically illustrated in the drawing and is elucidated in detail in the description that follows.

Figure 2:
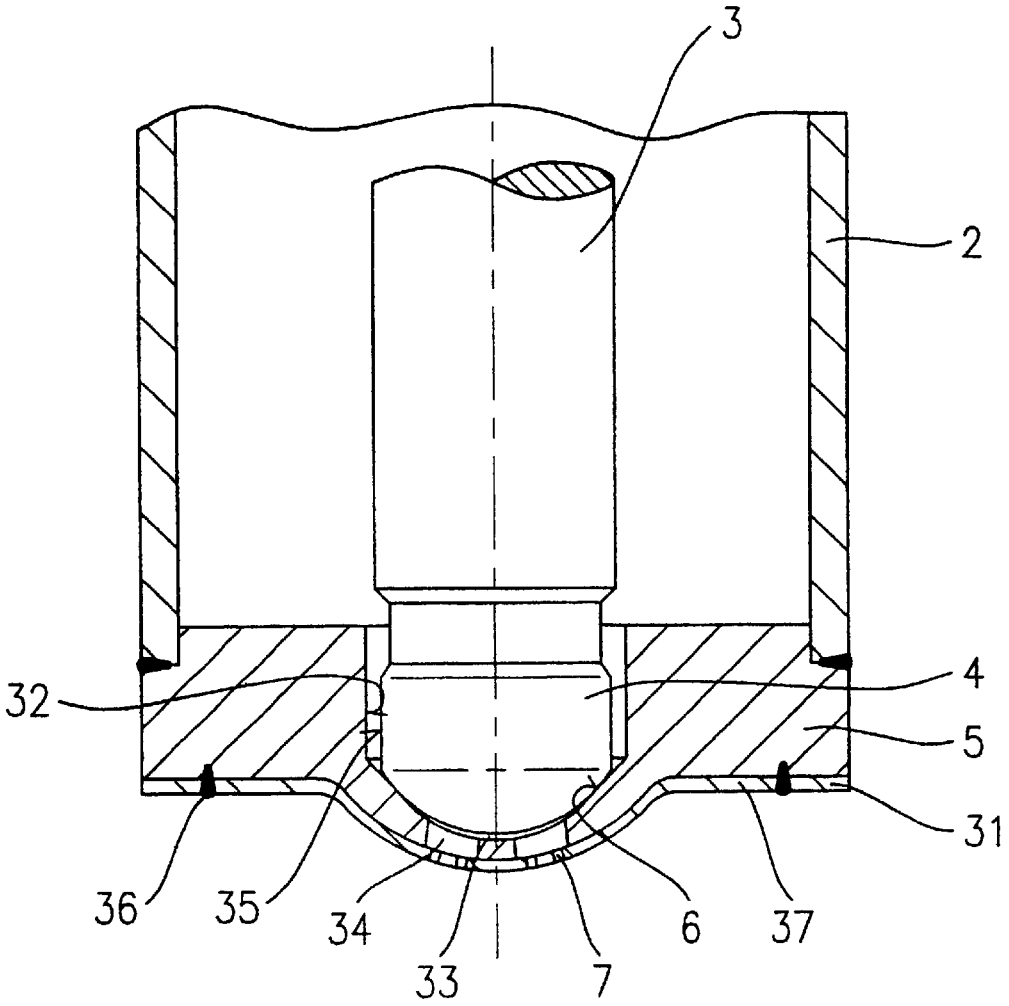

FIG. 1 shows a schematic overall section through an exemplary embodiment of a fuel injector according to the present invention; and FIG. 2 shows a schematic partial section in detail II of FIG. 1 through the exemplary embodiment of a fuel injector according to the present invention.

DETAILED DESCRIPTION OF THE EXEMPLARY EMBODIMENT

Before describing in detail an exemplary embodiment of a fuel injector 1 according to the present invention, the fuel injector according to the present invention shall be briefly explained first with reference to FIG. 1 in an overall illustration of its essential components for better understanding of the present invention.

Fuel injector 1 is designed as a fuel injector for fuel injection systems of compressed mixture, spark ignition internal combustion engines. In particular, fuel injector 1 is suitable for direct injection of fuel into a combustion chamber (not shown) of an internal combustion engine.

Fuel injector 1 includes a nozzle body 2, in which a valve needle 3 is situated. Valve needle 3 is mechanically linked to a valve closing body 4, which cooperates with a valve seat surface 6 situated on a valve seat body 5 to form a sealing seat. Fuel injector 1 is an electromagnetically actuated fuel injector 1 in this exemplary embodiment, which has a plurality of discharge orifices 7. Nozzle body 2 is sealed against external pole 9 of a solenoid 10 by a seal 8. Solenoid 10 is encapsulated in a housing 11 and wound onto a bobbin 12, which rests on an internal pole 13 of solenoid 10. Internal pole 13 and external pole 9 are separated by a gap 26 and supported by a connecting part 29. Solenoid 10 is excited by an electric current which is suppliable via a line 19 and an electric plug-in contact 17. Plug-in contact 17 is surrounded by a plastic sheathing 18, which may be extruded onto internal pole 13.

Valve needle 3 is guided in a disk-shaped valve needle guide 14, which is matched with an adjusting disk 15 used to adjust the valve lift. On the upstream end of adjusting disk 15, there is an armature 20, which is non-positively connected to valve needle 3, which is connected to flange 21 by a weld 22. A restoring spring 23 is supported by flange 21; in the present design of fuel injector 1, restoring spring 23 is pre-stressed by a sleeve 24 pressed into internal pole 13.

Fuel channels 30*a*, 30*b* run in valve needle guide 14 and in armature 20. A filter element 25 is situated in a central fuel feed 16. Fuel injector 1 is sealed against a fuel line (not shown) by a seal 28.

In the idle state of fuel injector 1, armature 20 is acted upon by restoring spring 23 via flange 21 on valve needle 3 so that valve closing body 4 is held on valve seat surface 6 in a sealing contact. When solenoid 10 is excited, it builds up a magnetic field, which moves armature 20 against the elastic force of restoring spring 23 in the direction of lift, the lift being defined by a working gap 27 existing between internal pole 13 and armature 20 in the rest position. Armature 20 entrains flange 21, which is welded to valve needle 2, and thus also valve needle 3 in the direction of lift. Valve closing body 4, which is mechanically linked to valve needle 3, lifts from valve seat surface 6, fuel flows past valve closing body 4, continues through recesses 34, which are situated in valve seat body 5, to discharge orifices 7 and is discharged.

If the solenoid current is switched off, after the magnetic field has sufficiently decayed, armature 20 drops off internal pole 13 due to the pressure of restoring spring 23 on flange 21, whereby valve needle 3 moves against the direction of lift. This causes valve closing body 4 to come to rest on valve seat surface 6 and fuel injector is closed.

FIG. 2 shows, in detail II of FIG. 1, a detailed partial section through a fuel injector 1 according to the present invention. A partially dome-shaped flow-through screen 31, corresponding to the downstream geometry of valve seat body 5 is secured by a weld 36. A plurality of discharge orifices 7, which are followed downstream by recesses 34 in valve seat body 5, are introduced in flow-through screen 31. Discharge orifices 7 represent the narrowest cross-section through which fuel flows, so that the amount of the metered fuel is determined by the total cross-section of discharge orifices 7.

Valve seat body 5 has a central recess 32, whose radial dimensions correspond to the radial dimensions of valve seat body 4, which has a spherical shape, for example. Central recess 32 tapers toward the downstream end and forms valve seat surface 6. A plurality of recesses 34 are introduced in valve seat body 5 downstream. These may be introduced in valve seat body 5 by drilling and connect discharge orifices 7 with volume 33 between valve closing body 4 and valve seat body 5, which is pressurized by fuel when fuel injector 1 is open.

Volume 33 is kept small due to the design of valve seat body 5 with an internal geometry which corresponds to that of valve closing body 4. The inside of valve seat body 5 may have a spherical shape, for example, whose radius is slightly smaller than that of valve closing body 4. Thus, when fuel injector 1 is closed, a definite seating of valve closing body 4 on valve seat surface 6 is ensured, while a minimum volume 33 is guaranteed. The discharge pattern is improved at the beginning and end of the discharge operation due to the small volume 33.

Central recess 32 of valve seat body 5 guides valve closing body 4 during the lift. Flats 35 are produced on valve closing body 4 in order to form a flow path to recesses 34. The flow path formed between flats 35 and valve seat body 5 has a greater cross-section than all discharge orifices 7 in flow-through screen 31 together, so that flow-through screen 31 with its discharge orifices 7 functions as the only throttling point limiting the flow rate.

Discharge orifices 7 in flow-through screen 31 are arranged on flow-through screen 31 so that the upstream end of each discharge orifice 7 originates from a recess 34 of valve seat body 5.

Discharge orifices may also be arranged in groups on flow-through screen 31, for example, so that each group of discharge orifices 7 originates from one recess 34 of valve seat body 5.

Discharge orifices 7 are preferably introduced in flow-through screen 31 prior to the latter being molded. This takes place, for example, via exact punching, the punching direction being perpendicular to the surface of flow-through screen 31, which is still flat. After the introduction of discharge orifices 7, flow-through screen 31 is given its final shape. For this purpose it is cold drawn, for example, according to the geometry of valve seat body 5, so that a flat annular flange 37 remains, for example, around the dome-shaped area, flange 37 being suitable for welding flow-through screen 31 to valve seat body 5.

The thickness of the disk from which flow-through screen 31 is manufactured is such that, for example, vibrations are induced in flow-through screen 31 by the fuel flowing through discharge orifices 7 when fuel injector 1 is open. This creates pressure conditions in the individual exiting fuel jets favoring finer atomization.

What is claimed is:

1. A fuel injector for a fuel injection system of an internal combustion engine, comprising:

a valve needle;

a valve seat body in which is disposed a valve seat surface;

a valve closing body mechanically linked to the valve needle and cooperating with the valve seat surface to form a sealing seat, the valve seat body including a plurality of recesses downstream from the sealing seat; and a flow-through screen situated downstream on the valve seat body, wherein:

in the flow-through screen, for each of the plurality of recesses, at least one discharge orifice is introduced, cross-section of the at least one discharge orifice is smaller than that of an associated one of the plurality of recesses, and an inlet cross-section of the at least one discharge orifice is situated fully within an outlet cross-section of the associated one of the plurality of recesses.

2. The fuel injector according to claim 1, wherein:

the at least one discharge orifice for each recess includes a plurality of discharge orifices, and the inlet cross-section of all discharge orifices situated downstream of one of the plurality of recesses is within the outlet cross-section of the one of the plurality of recesses.

3. The fuel injector according to claim 1, wherein:

the valve seat body and the flow-through screen have a corresponding dome-shaped geometry in a central area.

4. The fuel injector according to claim 1, wherein:

the flow-through screen includes a thin membrane in which vibrations may be induced.

5. The fuel injector according to claim 1, wherein:

downstream from the sealing seat, an inside of the valve seat body has a shape largely corresponding to that of the valve closing body.

6. The fuel injector according to claim 1, wherein:

the plurality of recesses in the valve seat body are introduced by drilling.

7. The fuel injector according to claim 1, wherein:

the at least one discharge orifice is introduced in the flow-through screen by punching.

* * * * *

UNITED STATES PATENT AND TRADEMARK OFFICE

CERTIFICATE OF CORRECTION

PATENT NO. : 6,764,031 B2
DATED : July 20, 2004
INVENTOR(S) : Thomas Sebastian et al.

It is certified that error appears in the above-identified patent and that said Letters Patent is hereby corrected as shown below:

Title page,
Item [57], ABSTRACT,
Delete "(3) (4) (6) (5) (34) (5) (5) (31) (34) (7) (34) (34)"

Column 1,
Line 4, change "Background Information" to -- Field of the Invention --
Lines 5-6, change "a fuel injector according to … main claim." to -- a fuel injector. --
Line 7, insert heasing -- Background Information --
Line 14, change "198 27 219A," to -- 198 27 219, --
Line 29, change "198 04 463 A1" to -- 198 04 463 --
Line 60, change "Advantages of the Invention" to -- Summary of the Invention --

Column 2,
Lines 20-23, delete "Advantageous refinements...of the subclaims."
Line 29, change "number of recesses must be" to -- number of recesses is --
Line 60, change "Drawing" to -- Brief Description of the Drawing --
Lines 61-64, delete "An exemplary...that follows."
Line 67, change "present invention; and" to -- present invention. --

Column 3,
Lines 5-6, delete "Of The Exemplary Embodiment"
Line 11, change "its essential components" to -- its components --

Column 5,
Line 13, change "cross-section of" to -- a cross-section of --

Signed and Sealed this

Fifth Day of April, 2005

JON W. DUDAS
*Director of the United States Patent and Trademark Office*